United States Patent [19]

Dunlop

[11] 4,068,703

[45] Jan. 17, 1978

[54] APPARATUS FOR CATALYTIC GASSING IN THE MANUFACTURE OF FOUNDRY CORES AND MOLDS

[75] Inventor: Andrew P. Dunlop, Riverside, Ill.

[73] Assignee: The Quaker Oats Company, Chicago, Ill.

[21] Appl. No.: 611,913

[22] Filed: Sept. 10, 1975

[51] Int. Cl.[2] ..... B22C 9/02

[52] U.S. Cl. ..... 164/160; 164/228; 264/82

[58] Field of Search ..... 164/12, 16, 7, 160, 164/228; 264/82

[56] References Cited

U.S. PATENT DOCUMENTS 3,934,810 1/1976 Henning ..... 249/127

FOREIGN PATENT DOCUMENTS 1,900,045 8/1970 Germany ..... 164/12

1,940,924 2/1971 Germany ..... 164/16

864,511 4/1961 United Kingdom ..... 164/16

*Primary Examiner*—Robert D. Baldwin

*Attorney, Agent, or Firm*—Joseph P. O'Halloran

[57] ABSTRACT

A shaped mass of particulate material such as foundry sand, admixed with a polymerizable binder, is instantly completely hardened by contact of gas catalyst therewith. The preferred method and apparatus in accordance with the present invention involves first inducing a vacuum within the shaping space of the shaping element and includes employing means for catalyst gassing of the space within the shaping element rather than of the space within the chamber in which the shaping element resides. In addition, a relatively small "after-void" chamber is provided and is connected to the shaping cavity at some location therein which is approximately opposite the location of the gas catalyst inlet. The latter eliminates uncured pockets which tended to result from prior methods and apparatus.

4 Claims, 4 Drawing Figures

APPARATUS FOR CATALYTIC GASSING IN THE MANUFACTURE OF FOUNDRY CORES AND MOLDS

BACKGROUND OF THE INVENTION

This invention relates to the manufacture of integrated masses of shaped particulate material such as foundry cores, and the like, by hardening gas catalyst-hardenable resin-bound shaped particulate masses, such as for example a sand mass with a gas catalyst.

The use of polymerizable liquid binders for the purpose of hardening binder-coated sand masses such as foundry sand mixes, for example, is well known. Heretofore, two general types of applications have been widely considered and adopted, namely those procedures in which the catalyst is admixed with the resin binder prior to the shaping of the catalyzed sand mass, and those procedures in which the binder is initially applied, and the catalyst is subsequently contacted therewith after the sand mass is shaped.

The procedures which involved catalyzing prior to shaping inherently suffered several serious short-comings. For example, with respect to the "cold cure" systems, the polymerizable binder, immediately upon admixing of catalyst therewith, tended to advance with resulting increase in viscosity. It is widely appreciated that the strength of the resulting hardened articles such as foundry sand articles, diminished as the binder inadvertently advanced in viscosity prior to the placement and packing of the curing sand mix in the sand shaping element. To overcome this short-coming, it was also widely appreciated that relatively slower acting catalyst could be employed, and that the catalyzed binder sand mixture could be heated after the sand mass had been shaped within the shaping element. These so-called "hot box" methods involved much higher capital investments; and the need for more complicated and more expensive shaping elements has been regarded as a definite short-coming of these "hot box" methods.

As an alternative to pre-mixing the catalyst and binder prior to the placement of the hardenable sand mix in a shaping element, it has been suggested to pack uncatalyzed binder coated sand in shaping elements, and subsequently contact the binder coating with gaseous catalyst. The packed binder-coated sand is extremely permeable with respect to the passage of gas therethrough.

The use of gas catalyst is well known in connection with the polymerization of gas catalyst polymerizable binder to produce shaped articles such as foundry sand cores and molds. Several processes have been suggested heretofore including the passing of a gaseous catalyst through shaped sand masses in which the sand particles have been precoated with a liquid gas-catalyst-polymerizable binder. In addition, it has been disclosed heretofore to use a procedure wherein the shaped sand mass is subjected to a vacuum, and in which the gas catalyst is released into the "vacuumized" sand mass for cure.

As a practical matter, however, these processes have also been generally less than satisfactory in the manufacture of shaped sand articles such as, for example, foundry articles. For example, the passing of gas catalyst through a complex shaped sand mass under pressure has been regarded undesirable inasmuch as remote portions of complex sand articles sometime remained uncured due to undesirable channeling of the gas catalyst through other regions of the shaped sand mass, none reaching the unhardened remote region.

In addition, the vacuum methods heretofore suggested have not proved completely satisfactory for foundry use for several reasons. First of all, the degree to which a vacuum can be induced in a foundry is, generally speaking, far less than the extent necessary to produce a "perfect vacuum". The vacuum methods suggested heretofore have proven to be unsatisfactory when the partial vacuums which are conveniently induced in a foundry environment are induced, e.g. above 50 mm Hg, or even above 300 mm Hg, with the result that some crucial portions of the shaped sand mass destined to confine molten metal remain uncured after catalyst gassing. These uncured portions generally separate and fall under force of gravity from the cured portion of the sand mass, upon stripping. Also, some gassing methods and apparatus heretofore suggested have generally involved the forming of an article in a core box, and possibly removing the shaped article from the core box, and placement of the shaped article which is sustained in shape only by its green strength, for example, in a gassing chamber for subsequent hardening by a gas catalyst. The placement of the article in a gassing-chamber and even the placement of a core box in a gassing chamber, has been less than desirable inasmuch as copious quantities of gas catalyst are required and vast excesses of the gas catalyst are lost due to the relatively large void in the vacuum chambers. The volume of the gassing chamber is usually relatively large with respect to the volume of the interstices of the shaped sand mass. The portion of the gas catalyst occupying the void space of the gassing chamber after the article is gassed is, of course, ineffective and is unused in the actual polymerization of the gas curable binder, and is, in that sense, totally wasted. In addition, such inefficient use of gaseous catalyst has encountered increasing objection in recent years due to increased awareness of environmental pollution by the excess wasted gas catalyst.

SUMMARY OF THE INVENTION

The apparatus and method disclosed herein relates to the provision of effective gassing means which involves gassing in the space within the shaping element only rather than within a large vacuum chamber containing one or more shapes. More importantly, in accordance with the present invention, means are provided for the gassing of the space within the shaping element which include a relatively small "aftervoid" chamber connected to the shaping cavity at a portion thereof which is approximately opposite the location of the gas catalyst inlet.

While I do not want to be bound by any theories with respect to the astounding and unexpectedly superior performance in accordance with the present invention, it is my present view, based on repeated observation, that the vacuum which is initially induced in sand shaping elements being less than perfect, involves the presence of relatively small but nonetheless substantial quantities of inert residual interstitial gas. When the catalyst gas is subsequently introduced to the system, the catalyst gas and the interstitial inert residual gas move through the sand shaped mass from the point at which the catalyst gas is introduced into the shaped sand mass towards opposite portions of the shaped sand mass. Based on my observations, I believe that the inert residual interstitial gas does, in effect, move ahead of the advance of the catalyst gas front and eventually forms a pocket or a region of catalyst-free inert gas at locations which are approximately opposite the entry point of the catalyst gas. The catalyst-free inert gas pocket, in effect, prevents the contacting of the catalyst gas with the shaped sand mass at that region within a reasonable period of time. As a consequence, those portions of the shaped sand mass at which the pocket or pockets of inert interstitial gas cushions reside, remains substantially non-hardened up to the time the sand shape is stripped from the mold. These regions of the sand mass remain unhardened, and, as indicated above, typically the unhardened sand separates from the hardened sand upon stripping. Generally speaking, the resulting sand shapes are unusable to confine metal during the founding process.

However, in accordance with the present invention, means are provided for the pocket of inert interstitial gas to retreat in front of a penetrating front of catalyst gas entirely through and out of the interstices of the shaping element to reside not within the sand but pass into the "aftervoid chamber". The consequence is that every portion of the sand mass is exposed to contact with the advancing catalyst gas front and the entire sand mass hardens substantially instantly upon contact with the gas catalyst.

The invention is described in general, and with respect to particularly preferred embodiments thereof, with the aid of the accompanying drawings in which.

Figure 1:
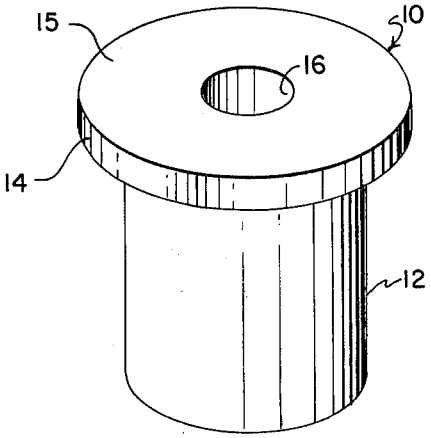
FIG. 1 is a perspective view of a mold for shaping sand shapes.

A flexible, distensible mold for use in accordance with the present invention is generally indicated by the numeral 10. Mold 10 includes a body portion 12 and a radially extending top flange portion 14 having top surface 15. Cavity opening 16 also serves as a withdrawal bore and loading port to shaping cavity 17. Mold 10 also includes a centrally located port 18 generally opposite of opening 16.

Figure 2:
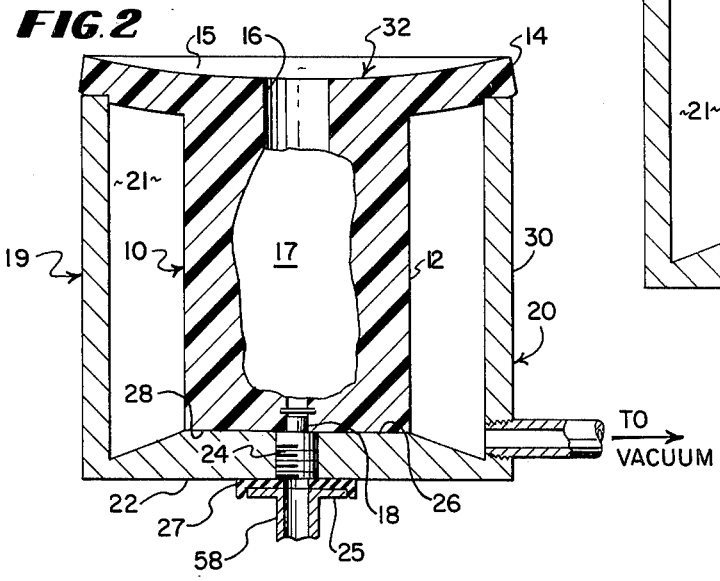
FIG. 2 is a vertical mid-sectional view through the mold of FIG. 1 showing the mold in operating position within a vacuum pot which is also shown in vertical mid-section.

Referring specifically to FIG. 2, mold 10 is shown in place within a "vacuum pot" which is generally indicated by the numeral 20. The assembly comprising mold 10 and vacuum pot 20 is generally indicated by the numeral 19. Mold 10 and vacuum pot 20 define air space 21 there between. Vacuum pot 20 includes a base 22 having port 24 passing therethrough at a position in alignment with mold vent port 18. Base 22 includes a top seating surface 26 which abutts the bottom surface 28 of mold 10, forming a gas-tight seal therewith. Thus, there is no connection between shaping cavity 17 and airspace 21. It is noted that the flexible distensible material from which mold 10 is formed serves automatically as a sealing gasket in the region in which surface 28 of mold 10 is seated on surface 26 of base 22. Other alternative sealing means can be used if desired.

Base 22 rests on a quick seal connector assembly 23 which comprises conduit 58 having annular radially extending flange 25 at the end thereof compressing gasket means 27 between flange 25 and base 22. In this way shaping cavity 27 is connected to the conduit 58 through conduits 18, 24 and connector assembly 23.

As indicated in FIG. 2 the dimensions of the mold 10 are such that the sidewalls 30 slightly lift the radially extending top portion 14 to form a depression generally indicated by the numeral 32 at the top surface 15 of mold 10.

Figure 3:
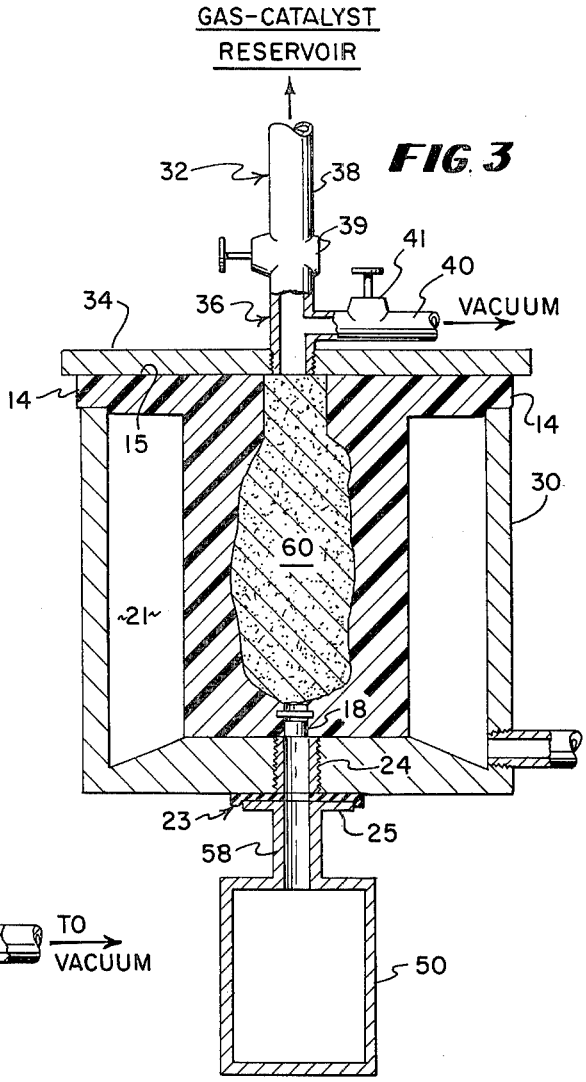
FIG. 3 is a vertical mid-sectional view as in FIGS. 2 showing an "aftervoid" in accordance with this invention, and the gassing head.

The function of the depression 32 is to allow for compression and constriction of radially extending flange portion 14 by the vacuum head 32 as it is lowered into the operating configuration shown in FIG. 3.

Referring specifically to FIG. 3 vacuum head 32 includes plate 34 which seats against top surface 15 and compresses radially extending flange 14 against sidewalls 30. This forms a pneumatic seal between plate 34 and the perimeter of surface 15, as well as between flange 14 and walls 30. Passing through plate 34 is conduit means 36, which are positioned to coincide with opening 16 in mold 10. Conduit means 36 is diagrammatically shown as branching into dual conduits, respectively identified as conduit 38 and conduit 40. Conduit 36 is diagrammatically connected to a catalyst-gas reservoir which is not shown in the drawings because it is conventional. Conduit 40 is connected to vacuum and vent means which are not shown because they are conventional and the specific types of vacuum means and vent means employed constitute no part of the present invention.

Port 24 is connected to a relatively small chamber 50 which I refer to herein as the "aftervoid". It is noted that port 24 is aligned with channel 18, and that channel 18 constitutes a passageway from shaping cavity 17.

Figure 4:
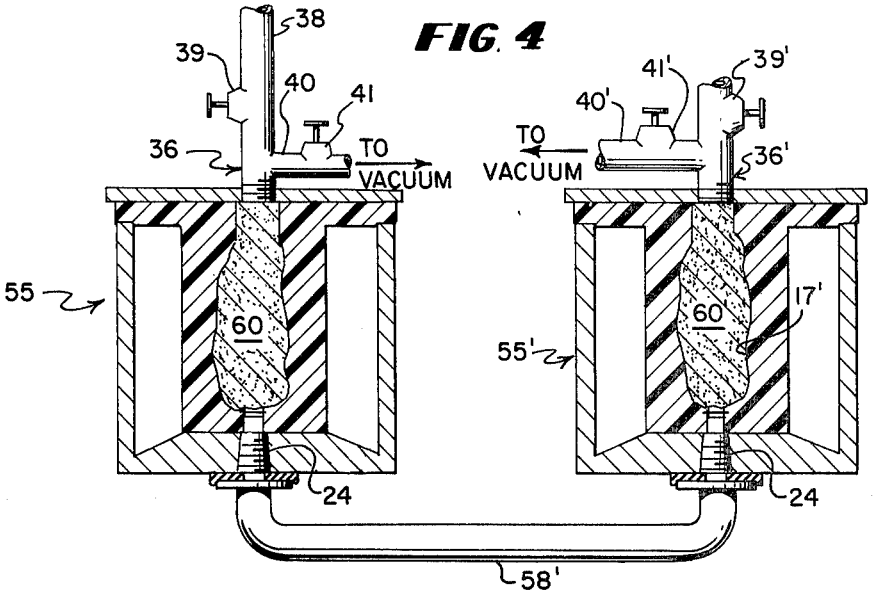
FIG. 4 is a diagrammatic sectional view as in FIGS. 2 and 3 showing two molds in pneumatic tandem wherein the second mold serves as the "aftervoid".

Referring now specifically to FIG. 4 the mold-vacuum pot assembly 55 comprising gassing head 32, mold 10 and vacuum pot 20, in the configuration shown in FIG. 3, except that exit port 24 is connected to a conduit 58 through a second exit port 24' to a second assembly 55' which is substantially identical to assembly 55. Parts in assembly 55' are identified by the same numbers used to identify parts in assembly 55 except that the numbers are primed. It will be appreciated from the following discussion that the void space of conduit 58' and the interstitial spaces within cavity 17' as well as the connected void space of conduit 36' constitutes the "aftervoid" equivalent to aftervoid 50 shown in FIG. 3.

PRACTICE OF THE INVENTION

The invention is further illustrated by use of the following numbered examples in which all amounts of ingredients are expressed in parts by weight unless otherwise indicated. All temperatures are expressed in degrees centigrade, and all percentages are expressed in percent by weight of the component referred to based on the weight of the overall mixture referred to, unless otherwise indicated.

All hardness data are determined on a Dietert scratch hardness blade tester Model 673S.

EXAMPLE 1

A foundry sand having uniformly coated thereon a liquid furfuryl alcohol resin in the amount of 0.7 percent by weight based on the weight of the sand is charged through opening 16 into cavity 17 to provide shaped sand mass 60 (see FIG. 3) which is struck off flush with surface 15. The volume of packed sand is approximately 380 parts by volume. The resin is approximately 45 percent furfuryl alcohol monomer, and 55 percent liquid furfuryl alcohol-urea-formaldehyde polymer. The resin is prepared from 90 parts furfuryl alcohol, 2.5 parts of urea, and 7.5 parts of formaldehyde. In addition to the resin is added 0.1 percent of "A1100" Silane (T.M. Union Carbide) which is reported to be gamma amino propyl triethoxy silane. The resulting resin used in this example contains about 2 percent water. Mold 10 is positioned in vacuum pot 20 as indicated in FIG. 2 and the gassing head 32 is positioned as indicated in FIG. 3. Initially the valve 39 is closed stopping conduit 36 at valve 39. Valve 41 is opened and a "vacuum" of 20 mm Hg. is induced within chamber 50, conduit 24, interstitial space within mass 60, and within the connected portions of conduit 36. It is appreciated that perfect "vacuums" are not normally encountered in industrial environs, particularly in foundries, and, in accordance with the present invention a perfect vacuum is not required. The extent of the vacuum induced need only be sufficient to permit the advancing front of the catalyst gas to pass through the shaped sand mass 60.

Subsequently valve 41 is closed, and valve 39 is opened wherein a hydrochloric acid gas-catalyst reservoir of 3000 units of volume at 760 Hg. pressure is connected with the relatively low pressure space within the shaping element 10. Based on observation through a glass-walled mold, I believe that substantially instantly, in less than 2 seconds, the inert residual gas within the spaces of the interstitial chamber moves ahead of an advancing front of catalyst gas passing through conduit means 36 and the interstitial inert residual gas passes through ports, 18, 24 into aftervoid 50. The furfuryl alcohol binder is instantly polymerized upon contact with the advancing hydrochloric acid gas and the now hardened sand mass 60 is instantly ready for removal from the shaping element. In this embodiment, chamber 50 has a volume of 3000 units of volume, and the equilibrium pressure was 480 mm Hg. The resin absorbed 2.9 percent catalyst, based on the weight of the resin.

The procedure of this example resulted in returning of the interstitial gas pressure to approximately atmospheric pressure, and vacuum head 32 is lifted from the top surface 15 of mold 10. Vacuum is then applied to the vacuum pot air space 21 causing the expansion of mold 10 in the manner well known in the art allowing hardened sand shape 60 to be withdrawn through opening 16. At 5 minutes after gassing the hardened sand shape has a scratch hardness of 84.0.

EXAMPLE 2

The procedure of Example 1 is repeated except that the apparatus diagrammatically illustrated in FIG. 4 is used. In this embodiment instead of the chamber 50 shown in FIG. 3, a mold-assembly 55' is utilized as the "aftervoid" and both the molds contain about 380 parts of the sand mix as described in Example 1. Each shaped mass 60, 60' has about 127 ml. of interstitial void space within each shaped sand mass.

In this instance, however, valves 39' and 41' are closed so that the space within conduits 24, 58, 24', 18, 18' and 36' up to valves 39' and 40' contribute to the space of the "aftervoid". The results which are achieved in this example are substantially identical to the results of Example 1 except that excess gas catalyst passing into mold 55' is utilized to start cures of bottom portion of sand mass 60'.

EXAMPLE 3

The equipment described in Example 1 was used in an additional test in which the sand was initially coated with 0.7 percent of a commercially available liquid resin identified as Farea 42, uniformly distributed on the sand. This resin is reported to comprise 42 percent furfuryl alcohol monomer, and 58 percent by weight of a "UF-85" which is an equilibrium mixture of 60 parts formaldehyde, 25 parts of urea, and 15 parts of water. Farea 42 is reported to have about 9 percent water.

An initial vacuum of about 20 mm of mercury was applied to the system and thereupon the vacuum pump and vent was isolated by closing valve 41, and valve 39 was opened. In this instance valve 39 is connected to 3000 parts by volume anhydrous hydrogen chloride gas closed reservoir at atmospheric pressure. Upon the opening of valve 39 the hydrogen chloride gas immediately pass through the sand mass 60 instantly hardening the sand mass 60. (Six seconds elapsed for the passage of the hydrogen chloride front through the sand mass.)

Analysis of the weight data indicated that approximately the amount of hydrogen chloride adsorbed by the resin constitute approximately 20 percent by weight based on the weight of the resin binder. The scratch hardness of the core 5 minutes after gassing was 72.

EXAMPLE 4

The procedure of Example 1 was repeated except that the aftervoid chamber 50 used in this example was approximately 2000 parts by volume and the resin employed was present in an amount of about 1 percent by weight based on the weight of the bound sand mix. The pressures encountered throughout the practice of the embodiment of this example were substantially identical to those of Example 1 except that about 470 mm of mercury was observed to be the equilibrium pressure, and approximately eight seconds were required for the gas to pass through the sand mass 60. Analysis of the weight data indicated that the pickup of anhydrous hydrogen chloride in the bound sand mass constituted approximately 9 percent by weight based on the weight of the resin. The scratch hardness, determined 5 minutes after gassing, was found to be 92.

EXAMPLE 5

The procedure of Example 1 was repeated except that instead of the anhydrous hydrogen chloride, boron trifluoride was used as the acid gas. The performance and the results achieved in accordance with this embodiment were substantially the same as those achieved in Example 1, except that the scratch hardness was determined to be 95. Upon repeated applications in accordance with this example using boron trifluoride it was noted that the scratch hardnesses were, generally speaking, in the range 90–100, and thus slightly higher than those achieved when hydrogen chloride gas is used.

GENERAL DISCUSSION

It is noted that Examples 1, 2 and 5, involve the pickup of relatively small amounts of hydrogen chloride gas in the binder. It is also noted that in Example 3 substantially higher levels of hydrogen chloride were picked up. This is believed to be due to the extreme solubility of hydrogen chloride in water, and it is noted that the liquid resin binder used in Example 3 had far higher water content than the binder used in Examples 1 and 2.

Also, one of the advantages unexpectedly and inherently flowing from the use of the method and apparatus in accordance with the present invention under vacuum conditions is the fact that the "excess" catalyst gas which passes through the shaping element into aftervoid 50 remains in aftervoid chamber 50 when assembly 20 is separated from aftervoid chamber 50, at connector 23, and a "fresh" assembly 20 having sand mass 60 packed therein is positioned over connector 23 as shown in FIG. 3. Chamber 50 still retains substantially all of the excess acid catalyst. Thus, when the vacuum is drawn through sand mass 60 and chamber 50 the "excess" acid catalyst residing in chamber 50 passes into sand mass 60 and a substantial portion, if not all, of the excess reactant is scrubbed from the gas by liquid coated sand mass 60. Thus, in accordance with the present invention, it is entirely satisfactory for an excess of the gaseous reactant to be provided to sand mass 60 inasmuch as any excess is passed into aftervoid chamber 50, and is subsequentially retained, or scrubbed, preferably into the mixed sand shape which is processed in the apparatus in accordance with the present invention.

The acid gas supply reservoir can be either low pressure or high pressure source. However, it is preferred that the acid gas reservoir be a relatively large volume chamber which contains the gas catalyst substantially at or below atmospheric pressure. It is also preferred that the pressures of the systems after the gas catalyst is permitted to pass into the shaped sand mass not exceed atmospheric pressure when noxious catalyst gasses are employed.

In its broadest aspects, the present invention involves passing a catalyst gas or reactant gas directly into the shaping element which contains a gas-polymerizable liquid resin bound particulate mass, wherein the shaping cavity is pneumatically connected to an aftervoid chamber through an aftervoid port, wherein the entry port through which the shaping cavity is gassed and the aftervoid port are substantially at opposite portions of the shaping cavity, and wherein catalyst gas is admitted to the shaping cavity at sufficient pressure to completely occupy the interstitial voids of the sand mass in the shaping cavity.

Generally speaking, no specific volume of the aftervoid is critical or essential. The size of the aftervoid must be sufficient, however, for the particular pressure differentials employed to permit the gas catalyst to pass at least through the entirety of the interstitial voids within the shaping cavity. For example, if a nearly "perfect vacuum" (for example 15 mm Hg.) were to be utilized, the volume of the aftervoid chamber 50 can be relatively small, particularly where the size and pressure of the acid catalyst reservoir is sufficient to result in a substantial equilibrium pressure e.g., approximately atmospheric pressure after the equilibrium is reached. On the other hand, if a low grade vacuum e.g., 300 mm Hg. is employed during the vacuum step, it is necessary, in accordance with the present invention, to provide a substantially larger volume aftervoid chamber 50 to result in the passage of the catalyst gas through the entirety of the interstitial voids in the shaping element. The adequacy of the volume of the shaping element, for a given pressure differential method, is readily determined, by simple experimentation. For example, if the remote portions (near the aftervoid conduit 18) of the bound sand in the shaping element are uncured, the volume of the aftervoid chamber is inadequate, and the volume of aftervoid chamber 50 can be increased by any obvious method, e.g. by putting two chambers in tandem. If the entirety of the sand mass is instantly hardened, it will be apparent that the volume of the aftervoid chamber is adequate. The volume may be decreased, experimentally, to provide a minimum volume which reliably produces adequate results. While I believe an estimate of the appropriate volume may be made by resorting to conventional gas law computations, solubility of gas catalyst in the binder, and other considerations lead me to prefer the simple empirical method outlined above for determining the adequacy of the aftervoid volume.

It is emphasized that there is no connection between air space 21 and shaping cavity 17. Only cavity 17 and aftervoid 50, and conduits associated therewith, are gassed with the gaseous catalyst. Also, even though the mold 10, in the preferred illustrated embodiment is made of flexible distensible material, this is not essential, and molds made of other materials may be used.

Although the process of the present invention is illustrated in the preferred embodiments by the use of hydrogen chloride gas with a furfuryl alcohol resin binder, any gas-hardenable binder systems can be used. For example, commercially available inorganic binders which are hardenable by carbon dioxide, and commercially available polymerizable organic systems which are hardenable upon contact with gaseous catalysts, are also useful in the process and apparatus of the present invention. In addition, for example, resin systems which are acid-polymerizable can be applied to the sand while containing a small amount of peroxide present in a liquid film to a particulate mass, and $SO_2$ applied as the gassing catalyst. In such an embodiment, the $SO_2$ is oxidized to $SO_3$ resulting in an acid condition within the liquid film, and the binder is polymerized accordingly, in accordance with the present invention.

I claim:

1. In an apparatus for shaping and hardening gas catalyst-hardenable binder-coated porous particulate masses, said apparatus comprising shaping means including a shaping cavity, and gassing means for introducing a gas-catalyst into interstitial voids in the particulate mass residing within said shaping cavity, whereby said gas catalyst is introduced at a first portion of the shaping cavity, the improvement comprising:

aftervoid chamber means connected directly to said cavity at a second portion thereof which is opposite said first portion of said shaping cavity, said aftervoid chamber means including a dead-end chamber of sufficient volume for the gas catalyst which is introduced at said first portion to pass at least through the entirety of the interstitial voids within said shaping cavity; and in which said aftervoid chamber comprises a second independent shaping means having a respective second shaping cavity filled with a second mass of said gas catalyst-hardenable porous packed liquid bound particulate material, and in which said means for connecting said first shaping cavity with said second shaping cavity are connected to the respective shaping cavities at second portions thereof opposite those respective portions of the respective shaping cavities into which the hardening gas is destined to be introduced.

2. In an apparatus for shaping and hardening gas catalyst-hardenable binder-coated porous particulate masses, said apparatus comprising shaping means including a first shaping cavity, vacuum means for lowering the gas pressure within the interstitial voids in a particulate mass in the shaping cavity, and gassing means for introducing a gas catalyst into said interstitial voids at a first portion of the shaping cavity, the improvement comprising:

aftervoid chamber means connected directly to said cavity at a second portion thereof which is opposite said first portion in said shaping cavity, said aftervoid chamber means including a dead-end chamber of sufficient volume for the gas catalyst to pass at least through the entirety of the interstitial voids within said first shaping cavity; and in which said aftervoid chamber comprises a second independent shaping means element having a respective second shaping cavity filled with a second mass of said gas catalyst-hardenable porous packed liquid bound particulate material, and in which said means for connecting said first shaping cavity with said second shaping cavity are connected to the respective shaping cavities at respective second portions thereof opposite those respective first portions into which the hardening gas is destined to be introduced.

3. In an apparatus for shaping and hardening masses of gas catalyst-hardenable binder-coated porous particulate material, said apparatus comprising shaping means including a shaping cavity, and gassing means for introducing a gas catalyst into interstitial voids in the particulate mass residing within said shaping cavity, whereby said gas catalyst is introduced at a first portion of the shaping cavity, the improvement comprising:

aftervoid chamber means connected directly to said cavity at a second portion thereof which is opposite said first portion of said shaping cavity, said aftervoid chamber means including a dead-end chamber of sufficient volume for the gas catalyst which is introduced at said first portion to pass at least through the entirety of the interstitial voids within said shaping cavity; and in which said aftervoid chamber comprises a second independent shaping means having a respective second shaping cavity filled with a second mass of porous packed liquid bound particulate material.

4. In an apparatus for shaping and hardening gas catalyst-hardenable binder-coated porous particulate masses, said apparatus comprising shaping means including a first shaping cavity, vacuum means for lowering the gas pressure within the interstitial voids in a particulate mass in the shaping cavity, and gassing means for introducing a gas catalyst into said interstitial voids at a first portion of the shaping cavity, the improvement comprising:

aftervoid chamber means connected directly to said cavity at a second portion thereof which is opposite said first portion in said shaping cavity, said aftervoid chamber means including a dead-end chamber of sufficient volume for the gas catalyst to pass at least through the entirety of the interstitial voids within said first shaping cavity, and in which said aftervoid chamber comprises a second independent shaping means element having a respective second shaping cavity filled with a second mass of said porous packed liquid bound particulate material.

* * * * *